United States Patent [19]

Shane et al.

[11] 4,212,286

[45] Jul. 15, 1980

[54] SHEET METAL FIREPLACE TYPE STOVE

[76] Inventors: Robert K Shane, 587 W. Market St., York, Pa. 17404; Glenn E. White, R.D. 4 Pine St., Dillsburg, Pa. 17019

[21] Appl. No.: 965,619

[22] Filed: Dec. 1, 1978

[51] Int. Cl.[2] ..... F24C 1/14

[52] U.S. Cl. ..... 126/77; 126/65; 126/83; 126/146

[58] Field of Search ..... 126/65, 77, 83, 146, 126/163 R, 245, 290

[56] References Cited

U.S. PATENT DOCUMENTS

| | | | |
|---|---|---|---|
| 716,922 | 12/1902 | McInnemy | 126/83 |
| 965,914 | 8/1910 | Laux | 126/146 |
| 1,620,235 | 3/1927 | Royse | 126/121 |
| 2,028,088 | 1/1936 | Davidson et al. | 126/121 |
| 2,508,028 | 5/1950 | Jones | 126/146 |
| 3,269,383 | 8/1966 | Maasberg | 126/164 |
| 3,942,509 | 3/1976 | Sasser | 126/121 |
| 4,019,492 | 4/1977 | Rush | 126/121 |
| 4,136,662 | 1/1979 | Willson | 126/77 |
| 4,154,210 | 5/1979 | Jaymes | 126/245 |
| 4,154,211 | 5/1979 | Choate | 126/65 |

*Primary Examiner*—James C. Yeung
*Attorney, Agent, or Firm*—C. Hercus Just

[57] ABSTRACT

A sheet metal stove comprising a shell of rectangular shape having a plurality of tubes extending between opposite sides thereof and extending therethrough to receive ambient air for combustion, adjustable dampers on the opposite ends of said tubes and slots therein between the ends to discharge air into the stove by convection, a grate supported by said tubes, a deflector sloping upwardly and forwardly from said grate, a door for the front of the stove having adjustable dampers therein to promote long burning of fuel, air heating conduits adjacent opposite sides of the shell to accept ambient air at the bottom and discharge heated air at the top, and a manifold on top of the shell to utilize combustion products before discharge to a flue to heat additional ambient air.

6 Claims, 4 Drawing Figures

10
12
14
16
18
20
22
24
26
28
30
32
34
36
38
40
42
44
46
48
49
50
52
54
56
58
60
62
64
66
68
72
74
76
78
80
82
84
86
88
3
3

10
12
14
18
20
22
24
26
28
30
32
34
36
38
40
48
58
60
64
74
78
80
82
84
86
88
2
2

SHEET METAL FIREPLACE TYPE STOVE

BACKGROUND OF THE INVENTION

Upon the advent of critical fuel shortages and especially fuel oil in recent years, considerable attention has been directed to the development of efficient fireplace and stove structures capable of consuming readily replenishable fuel such as wood. Wood has been a common type of fuel for many centuries for heating and cooking purposes but because of the relatively rapid consumption of the wood by conventional fireplaces, the use of substitute fuels over the years such as coal and, more recently, fuel oil, has been resorted to for purposes of heating houses and buildings.

Fossil fuel such as coal and oil are non-replaceable, whereas wood is replaceable and renewable. Because of this property and available supplies of wood, attention has been directed recently to the development of fireplaces and stoves which will utilize wood as a fuel but extend the burning time of the wood so that it will not be consumed as readily as when it is simply burned in an open fireplace, either with or without supplemental means to heat ambient air being included in and around the fireplace or stove structures.

In attempts to improve the combustion of fireplace fuel and especially wood, it has been common practice in recent years to provide perforated tubes connected to exhaust means of power operated fans for purposes of discharging air either as part of a grate or immediately associated with a grate. Examples of devices of this type are illustrated in the following U.S. Pat. Nos: 3,269,383 Maasberg Aug. 30, 1966; 3,942,509 Sasser Mar. 9, 1976; 4,019,492 Rush Apr. 26, 1977.

The structures of the foregoing patents have not included means to minimize the burning of fuel, such as by offsetting the combustion promoted by the forced air such as by utilizing dampers in closed fronts on the fireplaces or stoves by which the combustion occurs at a slower rate.

Basically, the use of hinged doors in the front of fireplace-type stoves has been proposed previously such as in U.S. Pat. Nos. 1,620,235, to Royse, dated Mar. 8, 1927 and U.S. Pat. No. 2,028,088 to Davidson et al, dated Jan. 14, 1936, and in which damper means mounted in the doors for the furnace or fireplace fronts apparently are employed to control the rate of combustion to a certain extent.

Although certain basic principles of efficient operation of fireplace structures are illustrated in various ways in the patents referred to specifically above, as well as other similar patented structures which are somewhat repetitive and duplicates of those discussed, it has been found that relatively inexpensive and highly efficient fireplace-type stove structures can be devised which employ certain modifications of the features presently found in prior structures and utilized and combined in different ways to maximize the efficiency of the fireplace-type stove and particularly to increase the time of burning of renewable fuels, such as wood, particularly logs, not only during daytime use, but particularly during the night when, normally a conventional fireplace will have completely consumed the fuel long before the oncoming day and it is necessary to start a fire again in the fireplace by conventional means.

Such more efficient structures and features are embodied in the present invention, details of which are described hereinafter.

SUMMARY OF THE INVENTION

It is one of the principal objectives of the present invention to provide a relatively inexpensive but highly durable and efficient sheet metal stove which, if desired, may be mounted within a fireplace recess or otherwise supported upon a floor surface in a room and the discharge from the top of the stove being connectable to a flue opening, said stove comprising a shell of rectangular shape in which a plurality of tubes extend between opposite sides thereof in spaced relation to the bottom and project through said sides to receive ambient air for combustion, the flow of such air being controlled by adjustable dampers on the sides of the shell for variable positioning over the opposite ends of the tubes, and slots extending longitudinally in opposite sides of said tubes intermediately of the ends, discharge air by convection into the interior of the stove, beneath a grate which is supported by said tubes, the stove also including a deflector which slopes upwardly and forwardly from the grate, the front opening of the stove preferably being closed by hinged doors and the front of the shell above said doors having adjustable dampers therein to promote the long burning of fuel due to the adjustability of the dampers in said front relative to the dampers over the ends of said tubes beneath the grate, and the grate primarily comprising firebrick supported by suitable frame means adjacent said tubes.

Another object of the invention is to render the operation of the aforementioned stove efficient in fuel consumption by the firebrick of the grate being spaced sufficiently to uniformly distribute combustion air from said tubes beneath the burning fuel and the brick, and in insulating the tubes from the actual combustion of fuel resting upon said bricks.

A further object of the invention ancillary to the foregoing object is to support the firebrick of the grate and additional firebrick which line the back and sides of the housing shell by simple and durable means.

Still another object of the invention is to form all parts of the stove from readily available metal sheets and strips which may be fabricated into the finished structure by welding for permanence, durability and strength.

Details of the foregoing objects and other objects thereof are set forth in the following specification and are illustrated in the accompanying drawings comprising a part thereof.

DETAILED DESCRIPTION

Figure 1:
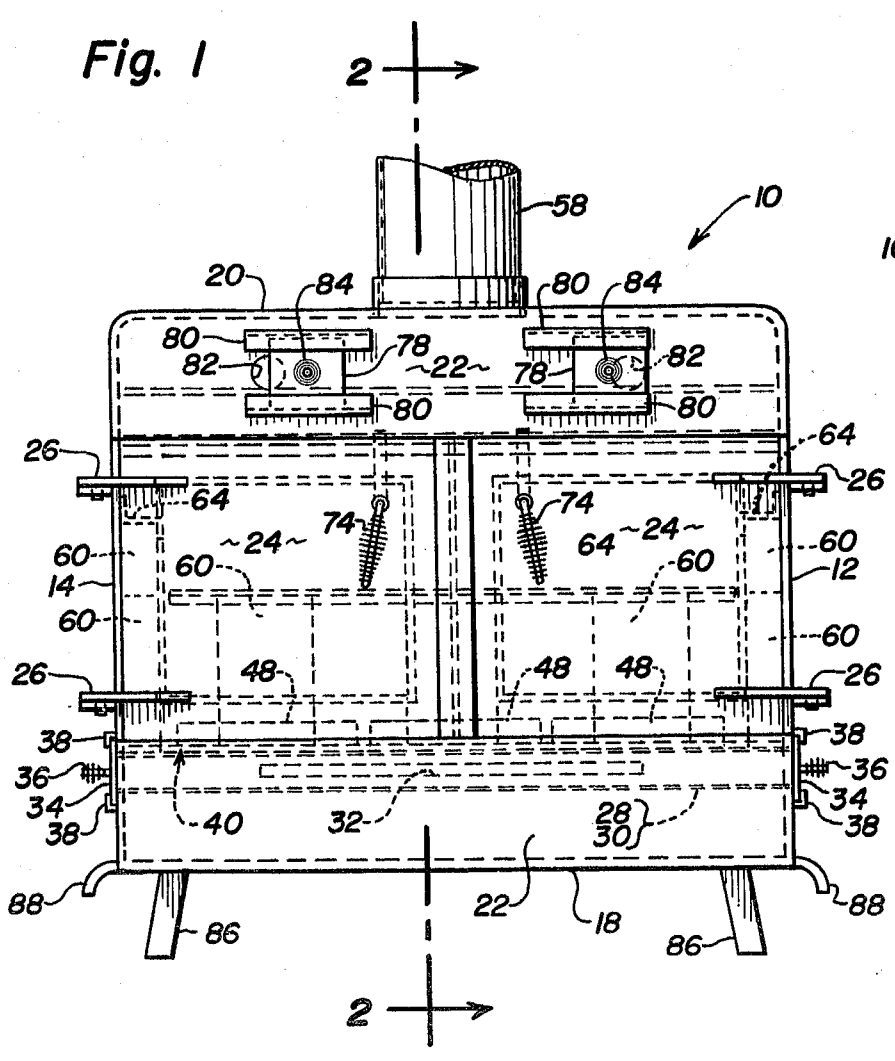
FIG. 1 is a vertical elevation of the front of a sheet metal stove embodying the principles of the present invention and illustrating fragmentarily at the upper end thereof a discharge pipe connectable to a flue.

Referring to FIG. 1 wherein a front elevation of the present invention is best illustrated, the sheet metal stove which is of the fireplace type, is especially adapted to utilize wood as a fuel and especially logs of suitable size. The principal objective of the invention is to extend the period of burning of the fuel over longer periods than normal in a conventional open fireplace. For example, it is possible to extend the burning of several logs over a period of many hours, such as twelve or fifteen hours, or even longer, especially by regulating the drafts and thereby increasing the efficiency of the stove to a high degree as compared with burning logs in an open fireplace.

Figure 2:
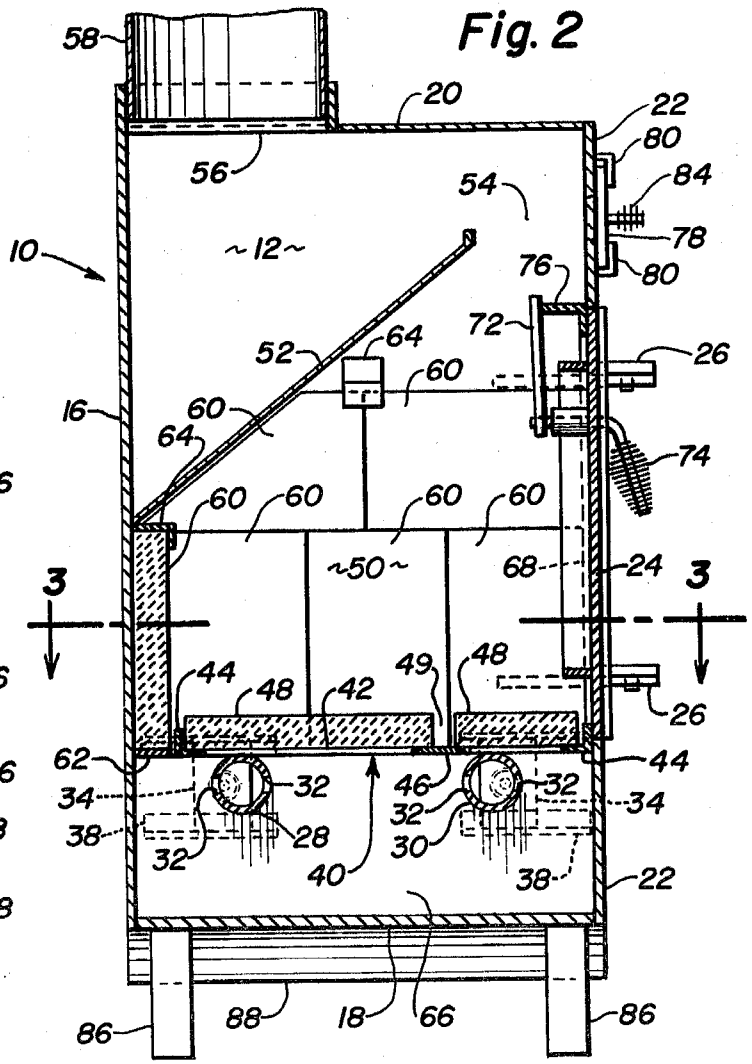
FIG. 2 is a vertical sectional elevation showing details of the stove shown in FIG. 1, as seen on the line 2—2 thereof, the scale employed in FIG. 2 being larger than that of FIG. 1.
Figure 3:
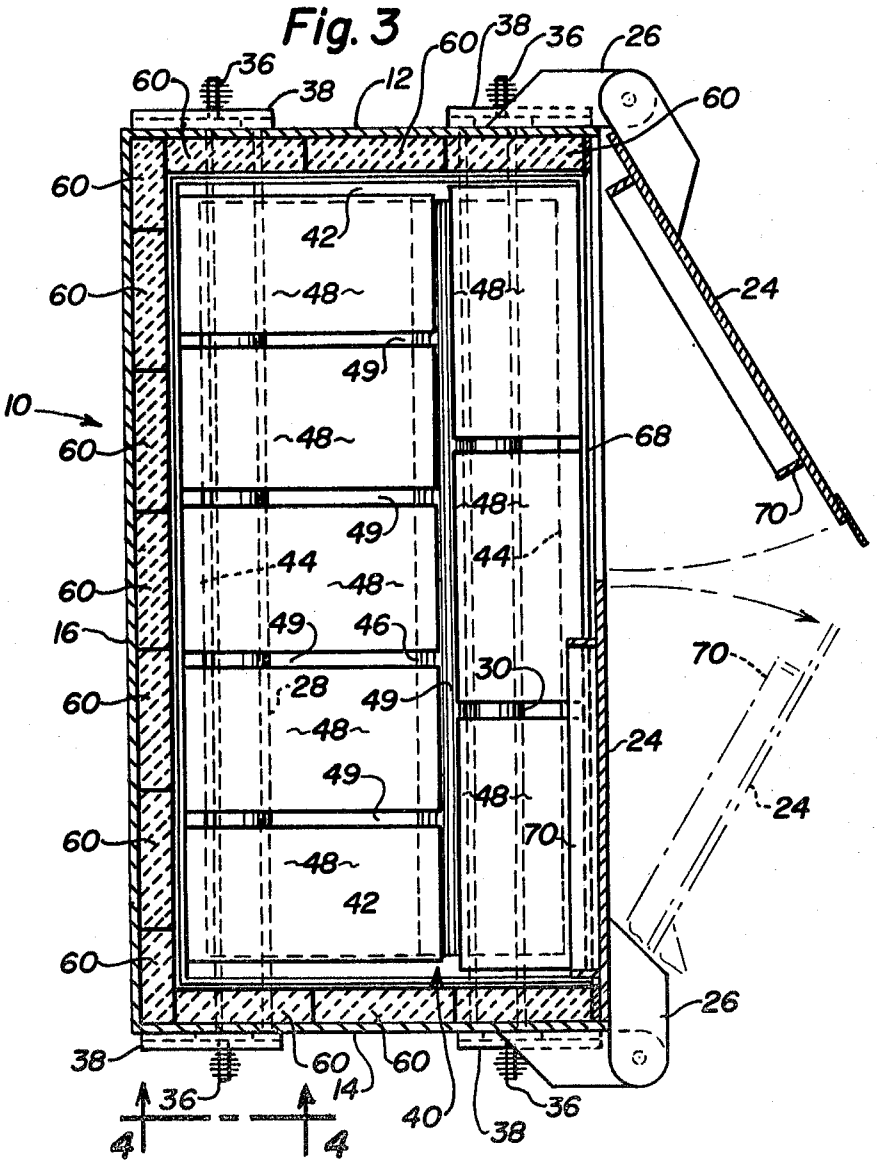
FIG. 3 is a horizontal sectional plan view on a similar scale to that employed in FIG. 2 and showing additional details of the stove of FIGS. 1 and 2, as seen on the line 3—3 of FIG. 2.

The stove comprises a substantially rectangular metal shell 10, sheet steel preferably being utilized in forming the shell. Steel of a suitable gauge is selected and the shell comprises opposite sides 12 and 14, a back 16 which is best shown in FIGS. 2 and 3, a bottom 18 and a top 20. Extending across the front 22 of the shell, which is outermost in FIG. 1 and is on the right side as viewed in FIG. 2, is a pair of doors 24. Said doors are hingedly connected to the forward edges of sides 12 and 14 by hinges 26 of heavy design, one leaf of each being welded to the doors and the other leaf being welded to the sides 12 and 14. The various panels of steel comprising the sides, back, bottom and top also are connected at the edges thereof either by bending, where suitable, or by welding the edges securely together.

In the lower portion of the shell 10, spaced above the bottom 18, a plurality, preferably a pair, of parallel, air-inlet tubes 28 and 30 are provided, these being shown in FIGS. 1–3. The ends of said tubes extend through suitable openings in the sides 12 and 14 and said ends flush with said sides and are welded thereto. Referring to FIG. 1, it will be seen that the tubes 28 and 30 are each provided with elongated slots 32, at suitable locations, such as along opposite sides as illustrated in exemplary manner in FIG. 2 and 4.

Figure 4:
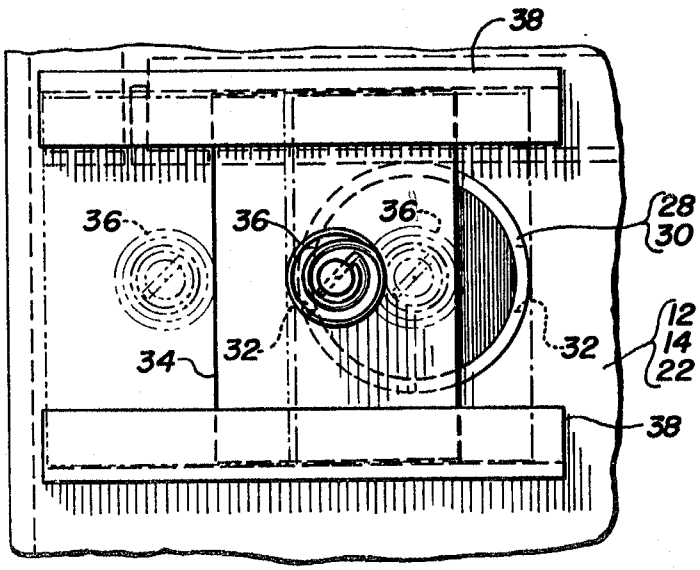
FIG. 4 is a fragmentary vertical elevation showing details of the type of damper means in the stove shown in FIGS. 1–3, one example being as seen on the line 4—4 of FIG. 3.

Each end of all of the tubes is provided with a manually adjustable damper 34 which, for example, preferably is in the form of a steel slide plate to which a handle 36 is fixedly attached. The handles 36 may be in the form of a coiled wire to provide comfort by minimizing heat transfer to the fingers of an operator. The dampers are slidable longitudinally in parallel guide members 38 which are flat angles or channels welded along one edge to the sides 12 and 14. In FIG. 4, the slide 34 is shown in full lines partially covering the open end of tubes 28 and 30; and in phantom, the slide is shown in two positions, respectively, fully open and fully closed. The operative position is selected as described hereinafter.

The purpose of the tubes 28 and 30 is to permit air to be introduced into the lower part of the shell 10 by convection as distinguished from forced draft, such as commonly employed in other burners of fireplace type in which draft is supplied by a small fan, driven by an electric motor, for example. Such forced draft tends to consume fuel too rapidly for purposes of the present invention, and thus, it has been found that by utilizing a convection-type of inlet of fuel-burning air, economy in the use of the fuel is effected.

By way of example, and without limitation, the tubes of one sample stove had an inner diameter of 2 inches and in tubes 30 inches long, slots 18 inches long and ½ inch wide were formed along opposite sides of the tube.

Preferably supported upon the tubes 28 and 30 is an appropriate grate frame 40, which preferably is removable and comprises a rectangular frame of substantially the same area as said bottom of said shell and formed of angle members, such as those having one inch flanges, for example, and without limitation. The frame comprises similar end channel members 42 and front and rear channel members 44, which are welded integrally at the ends thereof. Also, a supplemental metal strap 46 extends between the end members 42 and is welded thereto at its opposite ends as shown in FIGS. 2 and 3. The frame as described is supported preferably directly upon the tubes 28 and 30 and said frame supports a plurality of firebricks 48 which are of uniform size, one exemplary standard size being approximately 4½"×9"×1¼" thick, but other sizes may be used, if desired. The bricks are placed in the frame 40 in a suitable pattern, as shown in FIG. 3, for example, and in which limited spaces 49, such as ½" for example, exist between adjacent bricks to transmit combustion air from the tubes 28 and 30 to the combustion zone above the bricks. Said bricks also serve as partial insulation of the tubes from the combustion zone, thereby increasing the life and shape of the tubes.

The combustion zone 50, shown in FIG. 2 above bricks 48, is at least partially defined by a metal deflector 52, which extends upwardly and forwardly from a portion of the back 16 spaced a suitable distance above the grate frame 42 as clearly shown in FIG. 2. The upper and forward edge of the deflector 52 is inwardly spaced from the doors 24 in order to provide a passage 54 for products of combustion which, as viewed in FIG. 2 particularly, is also defined by top 20 of the shell 10 which has a flue opening 56 from which a stove pipe 58 extends to a flue, not shown.

The combustion zone 50 is lined with additional firebricks 60 along sides 12 and 14, and along back 16, the lower ends of which are supported upon ledge straps 62 of steel, see FIG. 2, welded at one edge to the sides and back, within the plane of the lower flanges of grate frame 40, for example. Said bricks are closely abutting each other for heat insulation and additional brackets 64, see FIGS. 1 and 2, or other suitable means, may be used to maintain the same in operable position. The vertical flanges of the angles 42 and 44 of grate frame 40 also aid in positioning bricks 60 operatively.

The grate frame 40 is spaced a suitable distance, such as about 6 inches, for example, above bottom 18 to provide an ash pit 66. Normally, ashes will not accumulate therein rapidly because most may be shovelled from the top of the firebricks 48, through the front opening 68, see FIG. 3, opposite the open door 24. The doors are reinforced by flanges 70 which are welded thereto and readily fit within front opening 68 when closed. Suitable latches 72 are rotatably supported by pivoted handles 74, preferably of coiled wire or otherwise for comfort, and the latches engage an upper bracing flange 76, see FIG. 2, welded interiorly along the upper edge of front opening 68.

Additional, relatively important air control means are provided on the upper portion of the front 22 in the form of a plurality of dampers 78 which may be of the simple type, such as side dampers 34. They are adjustably slidable in guide members 80 which may be similar to members 38 on the sides 12 and 14 for adjustable positions relative to air inlet holes 82 formed in the front wall 22 at desired locations and numbers suitable to permit passage of air therethrough to the upper part of combustion zone 50. The dampers 78 are shown in partial closing position over holes 82 in the left-hand part of FIG. 1, and in fully closed position in the right-hand part. By adjusting the dampers 78 by handles 84 relative to dampers 34 over the holes and tube ends respectively associated therewith, maximum burning times for fuel are achieved. By way of a specific example of combustion, one log 19 inches long and 10 inches in diameter burned 19½ hours by suitably regulating the dampers in a stove of which the shell was 30 inches square and 18 inches deep.

Preferably, the stove is supported on legs 86 to space the stove above a supporting surface and the ends of bottom 18 may terminate in skirts 88 for dress and to assist in handling the stove.

From the foregoing, it will be seen that the present invention provides a relatively simple type of sheet metal, fireplace-type stove which may be fabricated in a manner to insure long wear from simple stock, such as sheet and strip steel and steel tubes. The employment of cooperating sets of dampers of a convection type result in providing an adequate type of combustion without rapid consumption of the fuel, while simultaneously affording a very satisfactory supply of heat. Under circumstances where, especially for aesthetic purposes, it is desired to view the burning of the fuel, the door 22 may be opened for that purposes and the deflector plate 52 will direct a substantial amount of heat through the opening in the front of the shell 10.

While not specifically illustrated in the present drawings, it is to be understood that the stove described and claimed herein may be provided with a clean-out opening of suitable size, preferably in the lower horizontal panel of the front 22 of the shell of the stove. Further, to ease the clean-out operation, a horizontal shelf may be provided to extend horizontally outward from the lower edge of said lower portion of front 22, across the entire width. The clean-out opening should be closed by a door which may be a simple sheet of metal complementary in size to the opening and slidable upwardly or sidewise in guides, the same being smaller to the dampers 34 and 78 and the guides 38 and 80 therefor, whereby a rake or shovel may be used to remove ashes from the ash pit 66, all within the spirit of the invention. The length of the clean-out opening and door need not extend the full width of the lower panel of front 22 but should at least be long enough for easy removal of the ashes.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A sheet metal stove for burning logs and other types of wood fuel comprising in combination, a rectangular metal shell including opposite sides, a back, a top, and a bottom supported upon legs to space the same from a supporting surface, a plurality of parallel-spaced air inlet tubes extending between opposite sides of said shell fixed at the ends to air inlet holes in said sides which are spaced above the bottom of the shell to provide an ash-receiving space, a grate frame of similar area as said bottom and supported upon said tubes, said grate frame supporting a plurality of firebricks spaced short distances apart to permit passage of combustion air therethrough to a combustion zone above said bricks, manually adjustable dampers adjustably movable relative to the opposite ends of said tubes exteriorly of the sides of said shell to regulate incoming ambient air for combustion and said tubes having air discharge openings intermediately of the ends thereof to provide air by convection for combustion to rise through said spaces between the edges of said firebricks upon said frame to fuel when supported thereon, a metal deflector plate extending between the sides of said shell and extending upwardly and outwardly from the rear wall of said shell toward the front thereof, the lower edge of said deflector being spaced a limited distance above the inner edge of said grate and the upper edge being spaced from the top of said shell and from the front suitable distances to provide discharge of combustion products to a flue opening in said top of said shell, front door means hinged to the front of said shell and covering a front opening when closed, additional manually-operable damper means in said front above said front door means regulatable relative to said damper means for the ends of said tubes to control the combustion of fuel and effect economy thereof by extending the burning thereof, additional firebricks positioned vertically across said back and ends of said shell, and means attached to said back and ends of said shell to support said additional firebricks.

2. The stove according to claim 1 in which said grate frame comprises metal angle members welded together at the ends into a rectangular configuration, said members having vertical and horizontal flanges respectively to position and receive said firebricks in said spaced-apart relationship.

3. The stove according to claim 2 in which said grate frame further includes a metal strap extending between the ends of said frame and spaced between the front and rear sides thereof to provide supplemental support means for certain edges of said bricks when arranged in a pattern of conventional sizes of said bricks.

4. The stove according to claim 2 in which said means to support said additional firebricks comprise metal ledge straps welded at one edge to the back and sides of said shell substantially within the plane of the lower flanges of the angle members of said grate frame, whereby the vertical flanges of said angle members cooperate with said ledge straps to position said additional firebricks.

5. The stove according to claim 1 in which said grate-supporting tubes are spaced substantially apart for adequate support of said grate and said air discharge openings therein comprise elongated slots.

6. The stove according to claim 1 in which said manually-adjustable dampers for the ends of said air inlet tubes comprise metal plates slidably supported in parallel guide members fixed to the ends of said shell, and said dampers having handles therein for manual engagement.

* * * * *